United States Patent [19]

Terada et al.

[11] 4,142,853

[45] Mar. 6, 1979

[54] PROCESS FOR IMPROVING CELLULOSE FIBER PROPERTIES AND FOR DYEING THE SAME

[75] Inventors: Yasuhiko Terada, Kashihara; Jun Yasuda, Osaka; Masao Kuriyama, Itami, all of Japan

[73] Assignee: Shikibo Limited, Osaka, Japan

[21] Appl. No.: 696,709

[22] Filed: Jun. 16, 1976

[30] Foreign Application Priority Data

Jun. 17, 1975 [JP] Japan ..... 50-74097

[51] Int. Cl.[2] ..... D06M 13/20

[52] U.S. Cl. ..... 8/120; 8/66; 8/162 R

[58] Field of Search ..... 8/66, 162 R, 120

[56] References Cited

U.S. PATENT DOCUMENTS 2,170,024 8/1939 Heckert ..... 8/120

OTHER PUBLICATIONS

J. J. Willard, Textile Research Journal, vol. 37, No. 4, Apr. 1967, pp. 316-323.

R. W. Moncrieff, Man-Made Fibers, John Wiley & Sons, 1970, pp. 232-233.

Vickerstaff, The Physical Chemistry of Dyeing, Oliver & Boyd, 1950, pp. 253 & 262.

*Primary Examiner*—Paul R. Michl

*Attorney, Agent, or Firm*—Armstrong, Nikaido, Marmelstein & Kubovcik

[57] ABSTRACT

A process for improving the properties, particularly the dyeing properties, of cellulose fibers. The process comprises impregnating cellulose fiber with an aromatic acyl halide and thereafter immersing the impregnated fiber into an aqueous solution containing more than about 10% by weight of an alkali hydroxide to acylate the cellulose fiber on the surface portion thereof. In another embodiment of the invention, a continuous process for improving the properties of cellulose fiber yarn or fabric is provided. According to the continuous process, uniform acylation is achieved by maintaining the yarn or fabric in a stretched state during impregnation with the aromatic acyl halide and during the initial stages of immersion in the aqueous alkali hydroxide. The acylated cellulose fiber produced according to the invention may be dyed with good color fastness with disperse dyes and still retain the soft tactility characteristic of the fiber.

11 Claims, 1 Drawing Figure

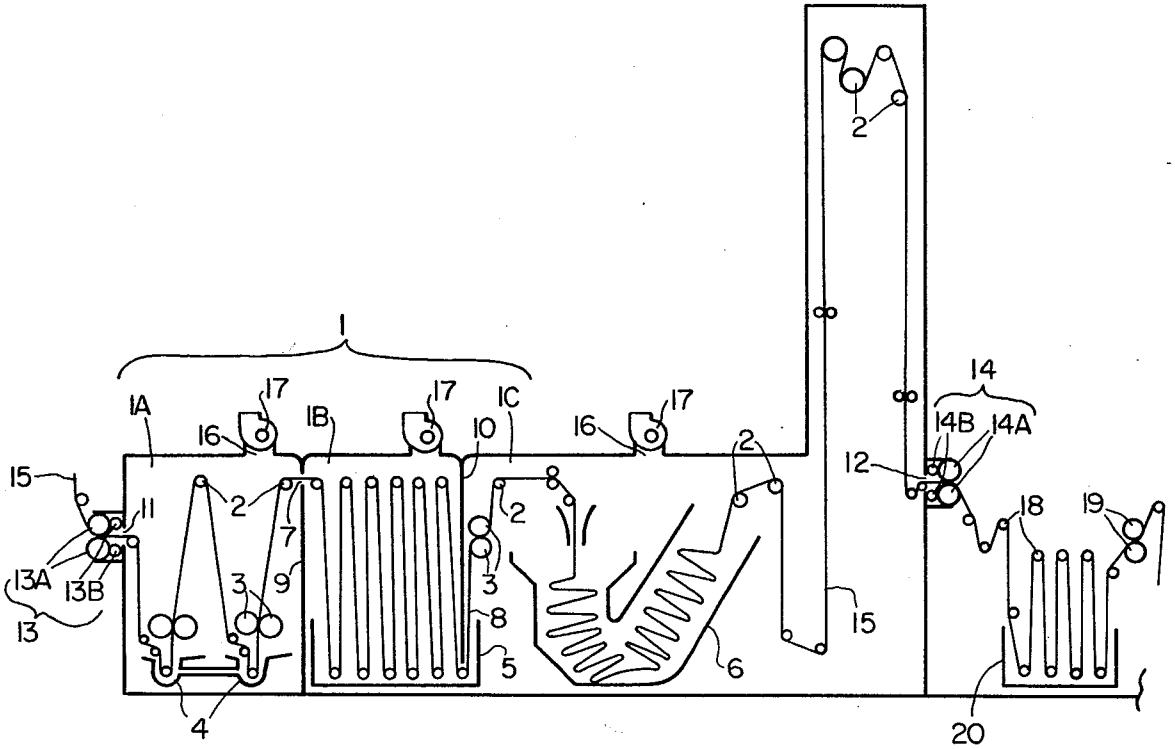
1
1A
1B
1C
2
3
4
5
6
7
8
9
10
11
12
13
13A
13B
14
14A
14B
15
16
17
18
19
20

PROCESS FOR IMPROVING CELLULOSE FIBER PROPERTIES AND FOR DYEING THE SAME

BACKGROUND OF THE INVENTION

1. Field of the Invention

This invention relates to a process for improving the properties of cellulose fiber, particularly the dyeing properties of cellulose fiber, and to a process for dyeing the same.

2. Description of the Prior Art

In general, disperse dyes have excellent color affinity to synthetic fibers, especially to polyester fibers, but have poor affinity to cellulose fibers. Thus, it is not possible to dye a product such as mixed yarn or union cloth composed of cellulose and synthetic fibers with disperse dyes. Such products can be dyed by a process in which the disperse dye is used in combination with a direct dye, reactive dye, soluble vat dye, or vat dye; the synthetic fiber portions being first dyed by the disperse dye and then the cellulose fiber portions being dyed by the direct dye, reactive dye, soluble vat dye or vat dye. The process, however, has disadvantages because it is intricate, time-consuming and gives a product with poor color fastness.

The above-mentioned product can also be dyed by a pigment dyeing process and by a process wherein Dyblen (registered trademark) dyes are used. The pigment dyeing process has the advantages that simultaneous printing can be carried out and operations are simple, but has the disadvantages that it gives a product having poor color fastness to rubbing and having a rough, coarse tactility. The Dyblen dyeing process has the advantage that simultaneous printing can also be carried out, but has the disadvantage that it gives a product having poor color fastness. Thus, none of the conventional processes provide good dye fastness to a product in the form of mixed yarns or union cloth of both cellulose fibers and polyester synthetic fibers. Those skilled in the art, therefore, have sought a process which can give color fastness to a product composed of both cellulose fibers and polyester synthetic fibers. In accordance with this general trend, it was attempted to determine whether or not there is a process wherein the cellulose fibers can be dyed with disperse dyes to give a product having good color fastness while retaining good tactility in the cellulose fibers.

It is known that cellulose fibers can be modified to give a product which has good affinity to disperse dyes and which can be dyed by disperse dyes when the cellulose fibers are either esterified or etherified. The thus esterified or etherified product, however, usually loses its soft tactility and becomes stiff, and hence is of no practical use because it has lost an essential property of the fibers. For example, when the cellulose fibers are acylated by a fatty acid such as acetic acid, propionic acid or butyric acid, the resulting fibers can be dyed easily with disperse dyes; the resulting fibers, however, are not good in color fastness, and especially are considerably degraded in color fastness to washing, although the resulting fibers are more or less improved in color affinity. In order to improve the color fastness of the resulting fibers, it is required either to acylate the cellulose fibers to a higher degree or to use a fixing agent at the time of dyeing. However, if the cellulose fibers are highly acylated or if a fixing agent is used, then the resulting fibers lose their characteristic tactility. Thus, conventionally acylated cellulose fibers did not come to have practical use.

In copending United States application, Ser. No. 661,825, filed Feb. 26, 1976, it is disclosed that benzoylation of cellulose fibers may be carried out, wherein the cellulose fibers are firstly treated with an alkaline solution and then with a benzoyl chloride, or wherein the cellulose fibers are reacted with benzoyl chloride in the presence of a basic medium such as pyridine, quinoline or dimethyl aniline. The resulting fibers, however, tend to lose the soft and flexural tactility characteristic of the cellulose fibers and hence become stiff and coarse.

To obtain cellulose fibers which can be easily dyed by disperse dyes and which have good tactility, it was attempted to esterify the cellulose fibers with various acids such as acetic acid and benzoic acid, and also to etherify, for example, cyanoethylate the cellulose fibers. As a result, it was found that cellulose fibers can be converted into a product, without deteriorating both the tactility and hygroscopic property of the fibers, which can be dyed with disperse dyes in vivid color and with good color fastness, if the cellulose fibers are acylated by an aromatic acid merely on the surface thereof to have an appropriate value of substitution degree of the acyl group.

Moreover, it was confirmed that the process in which such acylation is carried out is significant in that the cellulose fibers maintain excellent tactility after they have been acylated.

SUMMARY OF THE INVENTION

According to the invention it has been found that cellulose fibers can be benzoylated without losing their soft tactility, if the cellulose fibers are at first impregnated with a benzoyl chloride and then treated with an aqueous alkaline solution. The inventors have confirmed that, if the cellulose fibers are benzoylated in the order stated above, then the benzoylation can be carried out consuming only a small amount of acylating agent and other materials and that no specific apparatus is needed for carrying out the benzoylation; therefore, such method is advantageous.

Furthermore, according to the invention it has been determined that, when the cellulose fibers are at first impregnated with a benzoyl chloride, and then immersed in an aqueous alkaline solution, if the alkaline solution is diluted, the benzoylation reaction cannot be carried out to the extent desired, but if the alkaline solution is concentrated, the benzoylation reaction can be carried out as desired. It has also been determined that an alkaline solution containing approximately 10% by weight of an alkali hydroxide is the boundary between the diluted and concentrated alkaline solution.

Thus, according to the present invention, a process for improving cellulose fiber properties is provided which comprises firstly impregnating the cellulose fiber with an aromatic acyl halide and then immersing the resulting fiber in an aqueous solution containing more than 10% by weight of an alkali hydroxide thereby carrying out the aromatic acylation only on the surface portion of the cellulose fiber.

BRIEF DESCRIPTION OF THE DRAWING

The drawing shows an apparatus for carrying out a continuous process according to the present invention.

DESCRIPTION OF PREFERRED EMBODIMENTS

The cellulose fibers referred to in this invention may be natural fibers such as cotton fibers or may be regenerated cellulose fibers such as viscose rayon. Furthermore, the cellulose fibers may be in the form of cellulose fibers alone, or may be in the form of mixed yarns or union cloth composed of cellulose fibers and other synthetic fibers. Moreover, the cellulose fibers referred to herein may have not yet been formed into yarn by spinning; or they may be in the form of yarns; or they may be in the form of fabrics which are prepared by weaving or knitting the yarns. Among these possible forms of cellulose fibers, the present invention brings about a conspicuous effect when the cellulose fibers are in the form of mixed yarn or union cloth together with polyester fibers.

In this invention, when the cellulose fibers are impregnated with the aromatic acyl halide, the aromatic acyl halide may be used alone or together with an organic solvent or solvents by which it is to be diluted. In practice a suitable solvent or solvent mixture is selected from organic compounds which are non-reactive or only slowly reactive with the aromatic acyl halide, and which are miscible with the aromatic acyl halide. Suitable solvents are, for example, toluene, benzene, petroleum ether, kerosene, trichloroethane, trichloroethylene, dichloromethane, ethyl ether, acetone, and tetrahydrofuran. Preferably the solvent, if used, is employed in a small amount.

As the aromatic acyl halide which may be used according to the present invention are those wherein the aromatic acyl group is defined according to the general formula 1 of copending application, Ser. No. 661,825, incorporated herein by reference. Benzoyl chloride is a typical aromatic acyl halide useful according to the present invention. Other examples of the aromatic acyl halide are benzoyl bromide, p-chlorobenzoyl chloride, o-bromobenzoyl chloride, p-bromobenzoyl chloride, o-nitrobenzoyl chloride, m-nitrobenzoyl chloride, p-nitrobenzoyl chloride, 2,4-dinitrobenzoyl chloride, 3,5-dinitrobenzoyl chloride, 2,4,6-trinitrobenzoyl chloride, 3,4,5-triiodobenzoyl chloride and p-methoxybenzoyl chloride.

Various methods can be adopted in the step for impregnating the cellulose fibers with the aromatic acyl halide. For example, immersion, padding, spraying and the like may be employed. Such impregnation may be carried out at a temperature within the range of 0° to 60° C. It is not required to carry out the impregnation for a long period of time. The impregnation is carried out for an appropriate period of time within the range of several seconds to several hours. Immediately after the impregnation the cellulose fibers are squeezed to an appropriate squeezing ratio (based on the weight of the starting cellulose fibers), usually 10 to 120%, so that an appropriate amount of the aromatic acyl halide is retained in the cellulose fibers.

Typical examples of the alkali hydroxide which can be used in this invention are sodium hydroxide and potassium hydroxide. Other examples are rubidium hydroxide, cesium hydroxide, lithium hydroxide, strontium hydroxide and barium hydroxide. The alkali hydroxide may be a mixture of these. The alkali hydroxide is referred to hereinafter simply as the "alkali". The alkali must be used in the form of an concentrated solution. If the alkali is used in the form of a concentrated solution, the reaction velocity in which the cellulose fibers are esterified is greater than the reaction velocity in which esterified fibers thus formed are hydrolyzed, and hence the cellulose fibers are easily acylated. If, however, the alkali is used in the form of a dilute solution, the reaction velocity in which the cellulose fibers are esterified is smaller than the reaction velocity in which the esterified fibers are hydrolyzed, and hence it becomes difficult to acylate the cellulose fibers. The concentrated solution referred to herein is a solution containing more than approximately 10% by weight of the alkali. It is preferable to use a solution containing from about 10 to 30% by weight of the alkali.

During the time the cellulose fibers impregnated with the aromatic acyl halide are immersed in the alkali solution, i.e., a time sufficient for the acylation, the solution is well agitated. During the immersion the solution is maintained at a temperature of between 5° and 50° C., preferably at an ordinary, i.e., ambient, temperature and a temperature slightly less than the ordinary temperature. At these temperatures, the alkali in the concentrated solution accelerates esterification of the cellulose fibers caused by the aromatic acyl halide, and the cellulose substance located at the surface portions of the yarn or fabric is converted by a chemical reaction into a cellulose derivative, i.e., a cellulose acylated by the aromatic acid. Thus, the cellulose derivative is formed only on the surface portions of the yarn or fabric. The aromatic acylation, although dependent on temperature, is typically completed within 1 minute to 9 minutes.

According to the invention, the aromatic acyl halide is initially absorbed in the cellulose fibers and then the alkali solution is absorbed. Aromatic acylation occurs only on the surface portions of the yarn or the fabric. This is due to the fact that, if the cellulose fibers are at first immersed in the alkali solution, then the cellulose fibers are swollen by the alkali solution, so that the alkali solution penetrates into inner portions of the cellulose fibers. If, however, the cellulose fibers are immersed in the alkali solution after having first been immersed in the aromatic acyl halide, the cellulose fibers are hardly swollen by the alkali solution. Thus, the process of the present invention produces a yarn or fabric which is acylated only on the surface portion thereof, and which has an inner portion which is not acylated. The yarn or fabric obtained in the invention, therefore, retains an excellent tactility of pliant touch inherent to the cellulose fibers and is improved in the surface properties thereof.

Furthermore, according to this invention, the cellulose fiber acylated by the aromatic acid only on the surface portion thereof can be easily obtained having an excellent tactility and a substitution degree as desired. The term "easily" hereinabove means that temperatures and concentrations can be easily controlled during the reaction, because the aromatic acylation is carried out during immersion in an aqueous alkali solution, wherein a large amount of alkali solution can be employed, and that the aromatic acylation can be completed in a few minutes even at a temperature below the ordinary temperature. The term "easily" means further that a large amount of organic solvent is not needed. The terminology "a substitution degree as desired" means that acylated fibers having any substitution degree, whether it may be high or low, can be obtained as desired by varying the amount of the aromatic acyl halide contained in the cellulose fibers. As mentioned above, the process in this invention is remarkable in that the cellulose fibers can be advantageously acylated by the aromatic acid on a commercial scale.

Substitution degree means a mean value of the number of hydroxyl groups substituted by the aromatic acyl group in three hydroxyl groups contained in one glucose unit of cellulose fibers. If benzoyl chloride is employed as the aromatic acyl halide, then the substitution degree is, in fact, calculated by a weight method in the following manner:

substitution degree = (fabric weight after treatment − fabric weight before treatment) × 162.08 ÷ (fabric weight before treatment) × (105.12 − 1.01)

wherein 162.08 is the molecular weight of one glucose unit, 105.12 is the molecular weight of a benzoyl group, and 1.01 is the atomic weight of hydrogen.

The most conspicuous advantage of the invention is that a cellulose yarn or fabric can be obtained which has an excellent tactility. Heretofore, when a yarn or fabric of cellulose fibers was acylated by a conventional process, the resulting yarn or fabric became stiff and lost a soft tactility. However, when such a yarn or fabric is acylated according to the process of the invention, the resulting yarn or fabric does not lose a pliant touch. This advantage of the invention can be seen by measuring and comparing values of extensibility, flexibility shear stress and compressibility of the resulting yarn.

In general, in order that the yarn may keep its pliant touch, the yarn must have values as small as possible in extensibility, flexibility and shear stress and must have a value as big as possible in compressibility. According to the conventional process wherein the cellulose fiber yarn is at first immersed in the alkali solution and then treated with benzoyl chloride to form a benzoylated yarn, the resulting benzoylated yarn has fairly increased values of extensibility, flexibility and shear stress but a decreased compressibility. To the contrary, according to the present invention, the resulting benzoylated yarn has values of extensibility, flexibility, shear stress and compressibility which are similar to the values of untreated cellulose fibers as shown in the following table. Thus it is confirmed that the benzoylated yarn of the present invention is superior in tactility to the conventionally benzoylated yarn.

TABLE I

| Properties | | Untreated Knitted fabric | | Knitted fabric benzoylated by the process in this invention (substitution degree 0.25) | Kinitted fabric benzoylated by conventional process (substitution degree 0.25) |
|---|---|---|---|---|---|
| Extensibility | Young's Modulus (net) ($g/cm^2$) × $10^4$ | W | 0.49 | 0.49 | 0.52 |
| | | C | 0.73 | 0.73 | 0.80 |
| | Maximum Extension (g/cm) × $10^3$ | W | 0.16 | 0.16 | 0.18 |
| | | C | 0.20 | 0.21 | 0.23 |
| Compressibility | Compressive Ratio (%) | | 61.2 | 61.0 | 60.8 |
| Flexibility | Maximum Bending Moment (g . cm/cm) | W | 3.41 | 3.45 | 3.95 |
| | | C | 1.51 | 1.52 | 1.60 |
| | Flexible Stiffness (g . $cm^2$/cm) | W | 3.22 | 3.25 | 3.43 |
| | | C | 0.97 | 0.99 | 1.12 |
| Shearing Property | Maximum Shearing Force (g/cm) × 10 | W | 0.51 | 0.53 | 0.60 |
| | | C | 0.63 | 0.64 | 0.68 |
| | Shearing Stiffness (g/cm) × $10^{-2}$ | W | 8.73 | 8.76 | 8.97 |
| | | C | 10.1 | 10.5 | 11.3 |

In Table I, a knitted fabric benzoylated by a conventional process was prepared by impregnating a knitted fabric of cellulose fibers with sodium hydroxide and then treating the resulting fibers with benzoyl chloride; W reprents the wale direction, C the course direction; the flexibility and shearing property are shown in values per unit width of the fabric; extensibility is measured by JIS (Japanese Industrial Standard) L-1018, 5-21 (1962), compressibility is measured by JIS L-1018, 5-22 (1962), flexibility is measured by a method described in J. D. Owen, J. Text. Inst., 57, 435 (1966); and shearing property is measured by a method described in S. M. Spivak, J. Text. Res., 36, 1056 (1966).

The acylated yarn or fabric obtained by the present invention has the advantage that it can be printed by means of a transfer printing method using a sublimable disperse dye. Transfer printing is a method in which a sublimable disperse dye is printed before-hand on a support such as paper or a film, the support is placed on a fabric with the printed surface adjacent the fabric, the support is heated to sublimate the dye causing the dye to be transferred to the fabric. As a result, the printing is carried out.

In order to effectively carry out the transfer printing, it is preferable to keep the substitution degree of the aromatic acyl group at a value between about 0.10 and 0.50. For example, if benzoyl chloride is used as the aromatic acyl halide, the substitution degree may be kept at a preferred value in the manner described below. Cellulose fibers are at first immersed immediately in benzoyl chloride, squeezed sufficiently, and thereafter immersed at room temperature in an aqueous solution containing more than 10% by weight of sodium hydroxide. Alternatively, the cellulose fibers may be at first immersed in benzoyl chloride solution which is prepared by diluting benzoyl chloride with an equal amount by weight of an organic solvent, squeezed to a squeezing ratio of 100%, and thereafter immersed in an aqueous solution containing more than 10% by weight of sodium hydroxide. In either case, benzoylated cellulose fibers having a substitution degree of more than 0.2 can be obtained after about four minutes immersion in the aqueous sodium hydroxide solution. If the fibers are immersed in the aqueous sodium hydroxide solution for a more extended period of time, the benzoylated cellulose fibers formed therein are hydrolyzed by the sodium hydroxide solution.

The benzoylated cellulose fibers formed in the aqueous alkali solution are washed to remove the alkali and the organic solvent. The washing is preferably carried out at first with cold water, then with hot water, and thereafter with aqueous alkali solution. If the washing is imperfect, the resulting product has an inferior color fastness when transfer printing is applied to the product.

It is preferable that the process of the invention is continuously carried out if the process is to be put into industrial use. In order to carry out the acylation reaction continuously, it was thought that an apparatus should be installed having an elongated passage. The reason for this is that the material to be treated in this invention, i.e., yarns or fabrics, were supposed to have to be maintained in a stretched state during immersion both in the acylating agent and in the alkali solution, because it is difficult to carry out the acylating reaction evenly and uniformly owing to uneven absorption of these liquids when the yarns or fabrics are not maintained in the stretched state. Thus, it was thought that the yarns or fabrics should be maintained in a stretched state by rolls during the entire continuous process.

According to the present invention, however, it has been determined that it is possible to shorten the passage in the apparatus for carrying out the continuous acylating reaction. It has been confirmed that uneven acylation does not occur if the yarns or the fabrics are left in an unstretched state after having been immersed in the alkali solution in the stretched state for a short period of time as long as the yarns or the fabrics are maintained in the stretched state until the beginning stage of the immersion in the alkali solution. The continuous acylating process described hereinbelow has been completed on the basis of such confirmation.

According to another aspect of the present invention, therefore, a continuous process for improving a cellulose fiber yarn or fabric is provided which comprises continuously advancing a yarn or fabric containing cellulose fiber, immersing the advancing yarn or fabric in a vat containing an aromatic acyl halide while the yarn or fabric is maintained in a tight or flat or stretched state, immersing the yarn or fabric while still in the tight, or flat, or stretched state in a first vat of an aqueous solution containing more than 10% by weight of an alkali hydroxide, and thereafter immersing the yarn or fabric in an unstretched, or relaxed, state in a second vat of the aqueous solution containing more than 10% by weight of the alkali hydroxide, thereby carrying out aromatic acylation only on the surface portion of the yarn of fabric.

More particularly, the continuous acylating process may be carried out, for example, in the following manner. The yarn or fabric is at first immersed in the vat containing the aromatic acyl halide and impregnated fully with the acyl halide while maintained in a tight or stretched state. The yarn or fabric is then squeezed in the tight or stretched state. Thereafter, the yarn or fabric is immersed in the aqueous alkali solution. The aqueous alkali solution is divided into two portions, each of which is put in a separate vat. The yarn or fabric is passed through the first vat for a short period of time, i.e., within the range of fifteen seconds to three minutes, while maintained in a tight or stretched, or tense, state, and then is passed through the second vat for a longer period of time, i.e., within the range of forty five seconds to ten minutes while maintained in a unstretched, or loose, state. After having passed through the second vat, the yarn or fabric is washed with water, and if necessary, dried and taken out.

According to the continuous acylating process the yarn or fabric is maintained in the unstretched state in the latter part of the step wherein the yarn or fabric is immersed in the alkali solution, and thus the elongated yarn or fabric can be put into a vat of a comparatively small volume in such a state that the yarn or fabric is in a zigzag form close to a folded and overlapped form. The continuous process, therefore, does not require an apparatus having an elongated passage. Furthermore, because in the continuous process the yarn or fabric is maintained in the tight or stretched state at least in the steps wherein the yarn or fabric is immersed in the aromatic acyl halide and in the first vat of the alkali solution, it does not result in unevenly acylated yarn or fabric, even if the yarn or fabric is thereafter maintained in a loose state.

The invention is explained in further detail in the following examples.

EXAMPLE 1

In this example there was used as the benzoylating agent, a mixture of 500 parts by weight of benzoyl chloride and 500 parts by weight of white kerosene. A 100% cotton cloth was immersed into the mixture at 20° C. and for a sufficient time to impregnate the cloth with the benzoylating agent, and thereafter was squeezed to a squeezing ratio of 100%.

An aqueous solution was prepared containing 25% by weight of sodium hydroxide. The cloth was put in a large amount of the solution for four minutes at 20° C. while the solution was being agitated. Thus, benzoylation was carried out in the cellulose fiber only on the surface of the cloth.

The cloth was thereafter taken out from the solution, washed with cold water and then with hot water at 90° C., and dried for three minutes at 120° C. Thus a benzoylated cotton cloth was obtained having a substitution degree of 0.23. The benzoylated cloth has the characteristic that it can be dyed with disperse dyes, and can be easily printed by a transfer printing method. Additionally, the benzoylated cloth had an excellent tactility of pliant touch.

EXAMPLE 2

In this example there was used a 100% cotton cloth, which was acylated by a continuous process.

The drawing shows a schematic view of the process together with the apparatus, partly in section, used in the example.

In the FIGURE, chamber 1 contains a number of rolls 2, mangle 3, a vat for the acylating agent 4, first vat for the alkali solution 5, and second vat 6 for the alkali solution. Chamber 1 is separated by walls 9 and 10 having slits 7 and 8, each of which has dimensions just large enough to pass the cloth to be treated. Thus, chamber 1 is separated into three sub-chambers 1A, 1B and 1C. Chamber 1 is provided with inlet 11 and outlet 12, in each of which one or more sets of paired rolls are provided. More particularly, two sets of paired rolls 13A and 13B are provided in inlet 11 and two sets of paired rolls 14A and 14B are provided in outlet 14. Paired rolls 13A and 13B are positioned in close proximity to one another and to the substantially closed inlet 11 leaving a gap to pass the yarns or fabric. Paired rolls 14A and 14B are similarly arranged in outlet 12. Yarns or fabric 15 are at first pinched by paired rolls 13A and introduced into chamber 1; the yarns or fabric 15 are finally pinched by paired rolls 14A and removed from chamber 1. Chamber 1 is further provided with an arbitrary number of air vents 16, each of which is equipped with a discharging blower 17.

Chamber 1 is followed by at least one washing means comprising a number of rolls 18, mangle 19 and bath 20. If desired, a drying means may be attached next to the washing means.

In said apparatus, both an entrance and an exit for passing the yarns or fabric are substantially closed by paired rolls 13 and 14 provided in outlet 11 and inlet 12 of chamber 1, and the vapor in the chamber is discharged by blower 17. The inside of chamber, therefore, is somewhat reduced in pressure and a stimulative gas is not discharged from the chamber. Thus the apparatus is convenient for carrying out the continuous process.

Benzoyl chloride was used as the acylating agent and was placed in vat 4. 20% by weight of sodium hydroxide solution was placed in both vats 5 and 6. The inside of the chamber was maintained at 20° C. By driving three blowers 17, air was discharged from vents 16 and was introduced into an absorbing tower (not shown) to remove the stimulative gas. Alternately, fresh air may be introduced into inlets not shown in the drawing.

Fabric 15 was pinched by a pair of rolls 13A and introduced into sub-chamber 1A in chamber 1 through inlet 11. Fabric 15 thus introduced was supported and guided by a number of rolls 2 in a flat or tight state, and immersed in the acylating agent contained in vat 4 and impregnated with a sufficient amount of the acylating agent. The fabric was then squeezed by mangle 3 to a squeezing ratio 60%, and was thereafter introduced into sub-chamber 1B through slit 7 provided on wall 9. In sub-chamber 1B, the fabric was also supported and guided in a flat or tight state by a number of rolls 2, which were arranged in zigzag form as shown in the drawing, and thus was immersed in aqueous alkali solution (sodium hydroxide) contained in vat 5 for about one minute. Thereafter the fabric was introduced into sub-chamber 1C through slit 8 provided on wall 10, and therein was released from the stretched state and maintained in an unstretched state. Thus, the fabric was maintained in a state close to a sheet folded and left in a zigzag form. As a result, the fabric was immersed into the alkali solution in vat 6 for about three minutes. Vat 6 was sufficient having a comparatively short passage, because vat 6 could contain about forty times the length of the fabric which was held in the flat or tight state. While passing sub-chamber 1C, the fabric was acylated.

The resultant acylated fabric was supported and transferred by rolls 2 to outlet 12 of sub-chamber 1C, in which the fabric was pinched and taken out by paired rolls 14. Thereafter the fabric was supported and advanced by a number of rolls 18, and immersed in the water in bath 20 for washing. After the washing was repeated, the fabric was squeezed by mangle 19, and dried to obtain an evenly benzoylated fabric.

The benzoylated fabric had a substitution degree of 0.25 and a pliant tactility close to the properties as shown in Table I. The benzoylated fabric was suited for conducting a transfer printing.

The transfer printing was conducted as follows: The printing ink was an aqueous mixture comprising 25 grams per liter of carboxy-methyl cellulose and 35 grams per liter of a disperse dye (as shown in Table II) which was liable to sublimate and could be transferred at an elevated temperature. The printing ink was applied on a paper by means of a screen printing machine to obtain a transfer paper. The transfer paper was placed on the said benzoylated cotton fabric with its printed surface facing to, adjacent to, the fabric. They were heated and pressed at 200° C. for thirty seconds from the upper side of the paper. As a result, the printing ink on the paper was transferred to the cotton fabric to produce a dyed fabric, which had a deep clear color.

With respect to the dyed fabric, both the color fastness to washing (JIS L-1045 MC-4) and the color fastness to sunlight (JIS L-1044-irradiated for 40 hours) were measured. Results are shown in Table II. Thus, the fabric was confirmed to have excellent color fastness.

TABLE II

| Name of sublimable disperse dye | Color fastness to washing: Assessing change in color | Bleeding | Color fastness to sunlight |
|---|---|---|---|
| Miketon polyester red FB | 5 | 5 | 6 |
| Kayalon polyester yellow YLF | 4 | 5 | 7 |
| Sumikaron blue R | 4 | 4 | 5 |

We claim:

1. A process for acylating non-saponified cellulose fiber which comprises the first step of impregnating cellulose fiber with an aromatic acyl halide, and the second step of immersing the impregnated fiber containing the aromatic acyl halide into an aqueous solution containing more than 10% by weight of alkali hydroxide whereby the cellulose fiber is acylated.

2. The process of claim 1 wherein the aromatic acyl halide is benzoyl chloride, benzoyl bromide, p-chlorobenzoyl chloride, o-chlorobenzoyl chloride, o-bromobenzoyl chloride, o-nitrobenzoyl chloride, m-nitrobenzoyl chloride, p-nitrobenzoyl chloride, 2,.4-dinitrobenzoyl chloride, 3,5-dinitrobenzoyl chloride, 2,4,6-trinitrobenzoyl chloride, 3,4,5-triiodobenzoyl chloride or p-methoxybenzoyl chloride.

3. The process of claim 2 wherein said alkali hydroxide is sodium hydroxide, potassium hydroxide, rubidium hydroxide, cesium hydroxide, lithium hydroxide, strontium hydroxide or barium hydroxide.

4. The process of claim 3 wherein said impregnation is carried out at a temperature of from 0° to 60° C.

5. The process of claim 4 wherein the impregnated fibers are squeezed to a squeezing ratio of 10 to 120% prior to immersion in the alkali hydroxide.

6. The process of claim 5 wherein the immersion in the aqueous solution of alkali hydroxide is carried out at a temperature of from about 5° to 50° C.

7. A continuous process for acylating a cellulose fiber yarn or fabric which comprises the steps of advancing a non-saponified cellulose fiber yarn or fabric continuously, impregnating the advancing yarn or fabric with an aromatic acyl halide while the yarn or fabric is maintained in a stretched state, immersing the resulting impregnated yarn or fabric containing the aromatic acyl halide into an aqueous solution containing more than 10% by weight of alkali hydroxide while maintaining the yarn or fabric in the stretched state for at least the beginning period of immersion in the aqueous alkali solution whereby the cellulose fiber yarn or fabric is acylated.

8. The process of claim 7 wherein the impregnated yarn or fabric is maintained in a loose state during the latter period of immersion in the aqueous alkali solution.

9. A continuous process for acylating cellulose fiber yarn or fabric which comprises the steps of advancing a non-saponified cellulose fiber yarn or fabric continuously, impregnating the advancing yarn or fabric with aromatic acyl halide while the yarn or fabric is maintained in a stretched state, immersing the resulting impregnated yarn or fabric containing the aromatic acyl halide into a first aqueous solution containing more than 10% by weight of alkali hydroxide for a period of time between fifteen seconds and three minutes while the yarn or fabric is maintained in a stretched state, thereafter immersing the yarn or fabric into a second aqueous solution containing more than 10% by weight of alkali hydroxide for a period of time between forty five seconds and ten minutes while the yarn or fabric is maintained in a loose state whereby the cellulose fiber yarn or fabric is acylated.

10. A process for dyeing cellulose fiber with a disperse dye which comprises impregnating saponified cellulose fiber with an aromatic acyl halide, immersing the resulting fiber into an aqueous solution containing more than 10% by weight of alkali hydroxide to obtain a fiber acylated only on its surface portion, and thereafter dyeing the acylated fiber with a disperse dye.

11. A continuous process for dyeing a cellulose fiber yarn or fabric with a disperse dye, which comprises the steps of advancing a non-saponified cellulose fiber yarn or fabric continuously, impregnating the advancing yarn or fabric with an aromatic acyl halide while the yarn or fabric is maintained in a stretched state, immersing the resulting yarn or fabric into a first aqueous solution containing more than 10% by weight of alkali hydroxide for a period of time between fifteen seconds and three minutes while the yarn or fabric is maintained in a stretched state, thereafter immersing the yarn or fabric into a second aqueous solution containing more than 10% by weight of alkali hydroxide for a period of time between forty five seconds and ten minutes while the yarn or fabric is maintained in a loose state, to obtain a fiber which has been acylated only on the surface portion of the yarn or fabric, and thereafter dyeing the acylated fiber with a disperse dye.

* * * * *